US008056181B2

(12) United States Patent
Kim et al.

(10) Patent No.: US 8,056,181 B2
(45) **Date of Patent: *Nov. 15, 2011**

(54) VACUUM CLEANER AND INTAKE PORT UNIT THEREOF

(75) Inventors: Hyoung Jun Kim, Seoul (KR); Jay Ho Choi, Seoul (KR); Sung Il Park, Anyang-si (KR); Choon Myun Chung, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 1281 days.

This patent is subject to a terminal disclaimer.

(21) Appl. No.: 11/609,516

(22) Filed: Dec. 12, 2006

(65) Prior Publication Data

US 2007/0130720 A1 Jun. 14, 2007

(30) Foreign Application Priority Data

Dec. 13, 2005 (KR) ..... 10-2005-0122520

(51) Int. Cl.
*A47L 11/30* (2006.01)

(52) U.S. Cl. ..... 15/320

(58) Field of Classification Search ..... 15/320, 15/340.1, 340.2, 321, 50.1, 98
See application file for complete search history.

(56) References Cited

U.S. PATENT DOCUMENTS

| | | | | |
|---|---|---|---|---|
| 4,088,462 | A * | 5/1978 | Laule et al. | 55/437 |
| 4,120,180 | A * | 10/1978 | Jedora | 68/20 |
| 4,696,074 | A | 9/1987 | Cavalli | |
| 5,341,541 | A * | 8/1994 | Sham | 15/320 |
| 5,386,612 | A * | 2/1995 | Sham | 15/320 |
| 6,289,551 | B1 | 9/2001 | Basile | |
| 2004/0163199 | A1* | 8/2004 | Hsu | 15/320 |
| 2005/0198763 | A1 | 9/2005 | Lee et al. | |
| 2005/0236012 | A1* | 10/2005 | Josefsson et al. | 134/1 |
| 2006/0085941 | A1 | 4/2006 | Lee et al. | |
| 2006/0085942 | A1 | 4/2006 | Lee et al. | |
| 2006/0090285 | A1 | 5/2006 | Lee et al. | |
| 2006/0090288 | A1 | 5/2006 | Lee et al. | |
| 2009/0064447 | A1* | 3/2009 | Oh et al. | 15/320 |

FOREIGN PATENT DOCUMENTS

| | | | |
|---|---|---|---|
| EP | 1 027 855 | A2 | 8/2000 |
| EP | 1027855 | A2 | 8/2000 |
| GB | 636058 | A | 4/1950 |
| JP | 2-082928 | A | 3/1990 |
| KR | 10-1995-0012992 | B1 | 10/1995 |
| KR | 10-2002-002714 1 | | 4/2002 |
| KR | 20-0377710 | | 2/2005 |

(Continued)

OTHER PUBLICATIONS

U.S. Appl. No. 11/561,566 to Lee et al., filed Nov. 20, 2006.

(Continued)

*Primary Examiner* — Shay Karls
(74) *Attorney, Agent, or Firm* — McKenna Long & Aldridge LLP

(57) ABSTRACT

A vacuum cleaner and an intake port unit thereof are disclosed, by which a steam cleaning can be conducted together with a vacuum cleaning. The intake port unit includes a housing. A vacuum intake passage is provided within the housing for passage of air sucked in from the exterior of the housing, and a steam generator is provided within the housing to generate steam. A steam discharge passage is provided within the housing for passage of steam discharged to the exterior of the housing. The steam discharge passage is partitioned from the vacuum intake passage.

16 Claims, 7 Drawing Sheets

FOREIGN PATENT DOCUMENTS

| | | | |
|---|---|---|---|
| KR | 10-2005-0032699 | A | 4/2005 |
| SU | 2091053 | C | 9/1997 |

OTHER PUBLICATIONS

U.S. Appl. No. 11/566,943 to Chung et al., filed Dec. 5, 2006.
U.S. Appl. No. 11/567,363 to Lee et al., filed Dec. 6, 2006.
English language Abstract of KR 20-0377710.
English language Abstract of KR 10-2002-002741.
English language Abstract of KR 10-1995-0012992 B1.
English language Abstract of EP 0684006.
English language Abstract of KR 10-2005-0032669 A.
English language Abstract of JP 2-082928 A.

* cited by examiner

VACUUM CLEANER AND INTAKE PORT UNIT THEREOF

This application claims the benefit of the Korean Patent Application No. 10-2005-0122520, filed on Dec. 13, 2005, which is hereby incorporated by reference in its entirety.

BACKGROUND OF THE INVENTION

1. Field of the Invention

The present invention relates to a vacuum cleaner, and more particularly, to a vacuum cleaner and intake port unit thereof. Although the present invention is suitable for a wide range of applications, it is particularly suitable for performing both vacuum cleaning and steam cleaning.

2. Discussion of the Related Art

Generally, a vacuum cleaner is a device that performs cleaning by sucking in air with dirt or dust from a floor or surface, filtering out the dirt or dust, and discharging the air. Vacuum cleaners are popularly used due to their convenience of use.

However, vacuum cleaners which perform cleaning by only sucking air have difficulty in cleaning up particles stuck on a floor, or removing stains from a floor. Recently, efforts have been made to develop a steam cleaner capable of removing particles stuck on a floor or stains from a floor.

FIG. 1 is an exploded perspective diagram of a steam cleaner according to a related art.

Referring to FIG. 1, a steam cleaner according to a related art consists of a body or unit 10 configured as an exterior of the steam cleaner, a heater or burner unit 20 provided within the unit 10 to generate steam by heating water, a control part 30 for selectively activating supply of the steam generated by the burner unit 20 and for controlling the amount of the supplied steam, a connecting hose 40 with one end connected to the unit 10, and a head part 50 connected to another end of the connecting hose 40 to spray the steam.

The head part 50 may be of various configurations or shapes, which may be detachably attached to the connecting hose 40. In this manner, a head part 50 having a shape suitable for a particular area to be cleaned may be attached and used.

Once a user activates the steam cleaner, steam is generated from the burner unit 20 provided within the unit 10 and is then sprayed from the head part 50 via the connecting hose 40 to remove filth or stains from a floor, or to facilitate removable by making the filth or stains moist or soft.

However, the above configured related art steam cleaner has the following problems.

First, the related art steam cleaner is not provided with a vacuum cleaning function, and thus does not permit normal vacuum cleaning. Accordingly, a separate vacuum cleaner is also required.

Second, in order to smoothly remove filth or stains from a floor, a pressure of steam blown from the head part should be maintained at a prescribed level. However, since the burner unit 20 generating the steam is provided within the unit 10, the steam generated from the burner unit 20 must be carried to the head part 50 via the connecting hose 40, which results in a lengthy flow path for the steam. The pressure and temperature of the steam are lowered during the lengthy flow, so that cleaning power of the steam is reduced. In order to compensate for this problem, the blowing pressure and temperature of the steam generated from the burner unit must be set higher. This raises product and operation costs for the cleaner.

SUMMARY OF THE INVENTION

Accordingly, the present invention is directed to a vacuum cleaner and intake port unit thereof that substantially obviate one or more problems due to limitations and disadvantages of the related art.

An object of the present invention is to provide a vacuum cleaner and intake port unit thereof, by which a steam cleaning can be conducted together with a vacuum cleaning and by which a flow path of steam can be reduced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an intake port unit for a vacuum cleaner includes a housing; a vacuum intake passage provided within the housing for passage of air sucked in from the exterior of the housing; a steam generator provided within the housing to generate steam; and a steam discharge passage provided within the housing for passage of steam discharged to the exterior of the housing, wherein the steam discharge passage is partitioned from the vacuum intake passage.

Preferably, the intake port further includes a vacuum intake port provided on one side of a bottom of the housing to suck in exterior air, the vacuum intake port being connected to the vacuum intake passage; and a steam discharge port provided on another side of the bottom of the housing spaced from the vacuum intake port to discharge steam, the steam discharge port being connected to the steam discharge passage.

Preferably, the vacuum intake passage is configured to be connected to a vacuum source outside of the housing.

Preferably, a floorcloth is detachably attached to a bottom of the housing. More preferably, a floorcloth is detachably attached to the bottom of the housing over the steam discharge port.

Preferably, the steam generator includes a water tank provided within the housing; and a boiler that heats water supplied from the water tank. More preferably, the water tank is configured to be removed from and inserted into the housing.

Preferably, the steam generator further includes a valve for connecting the water tank and the boiler, wherein the valve is configured to be opened when the water tank is inserted into the housing, and closed when the water tank is removed from the housing.

Preferably, the boiler includes a boiler case storing the water supplied from the water tank; a heater that heats the water in the boiler case; and a steam discharge pipe having an upper end positioned within the boiler case, spaced from an upper wall of the boiler case, and a lower end communicating with the steam discharge passage.

More preferably, the boiler further includes a shield positioned between the upper end of the steam discharge pipe and the upper wall of the boiler case to prevent condensed water from entering the steam discharge pipe. More preferably, the shield has a conical shape with a downwardly increasing circumference to prevent condensed water on the upper wall of the boiler case, and condensed water on a bottom of the shield, from entering the steam discharge pipe.

A vacuum cleaner according to the present invention includes a vacuum unit containing a suction source; a pipe extending from the vacuum unit to provide a passage for air intake; and an intake port unit connected to an end portion of the pipe to suck in exterior air from a surface to be cleaned, the intake port unit containing a steam generator that generates steam and a steam discharge passage through which steam is discharged toward the surface to be cleaned.

Preferably, the vacuum cleaner further includes a control unit provided on the pipe for selectively activating the suction source and the steam generator.

Preferably, the intake port unit includes a housing containing the steam generator and the steam discharge passage; and a vacuum intake passage provided within the housing for passage of air sucked in from the exterior of the housing, wherein the steam discharge passage is partitioned from the vacuum intake passage.

More preferably, the intake port unit further includes a vacuum intake port provided on one side of a bottom of the housing to suck in exterior air, the vacuum intake port being connected to the vacuum intake passage; and a steam discharge port provided on another side of the bottom of the housing spaced from the vacuum intake port to discharge steam, the steam discharge port being connected to the steam discharge passage.

Preferably, a floorcloth is detachably attached to a bottom of the housing.

Preferably, the steam generator includes a water tank provided within the housing; and a boiler that heats water supplied from the water tank, wherein the water tank is configured to be removed from and inserted into the housing.

More preferably, the steam generator further includes a valve for connecting the water tank and the boiler, wherein the valve is configured to be opened when the water tank is inserted into the housing, and closed when the water tank is removed from the housing.

Preferably, the boiler includes a boiler case storing the water supplied from the water tank; a heater that heats the water in the boiler case; and a steam discharge pipe having an upper end positioned within the boiler case, spaced from an upper wall of the boiler case, and a lower end communicating with the steam discharge passage.

More preferably, the boiler further includes a shield positioned between the upper end of the steam discharge pipe and the upper wall of the boiler case to prevent condensed water from entering the steam discharge pipe.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A vacuum cleaner and intake port unit thereof according to one embodiment of the present invention are explained with reference to FIGS. 2 to 7.

Figure 1:
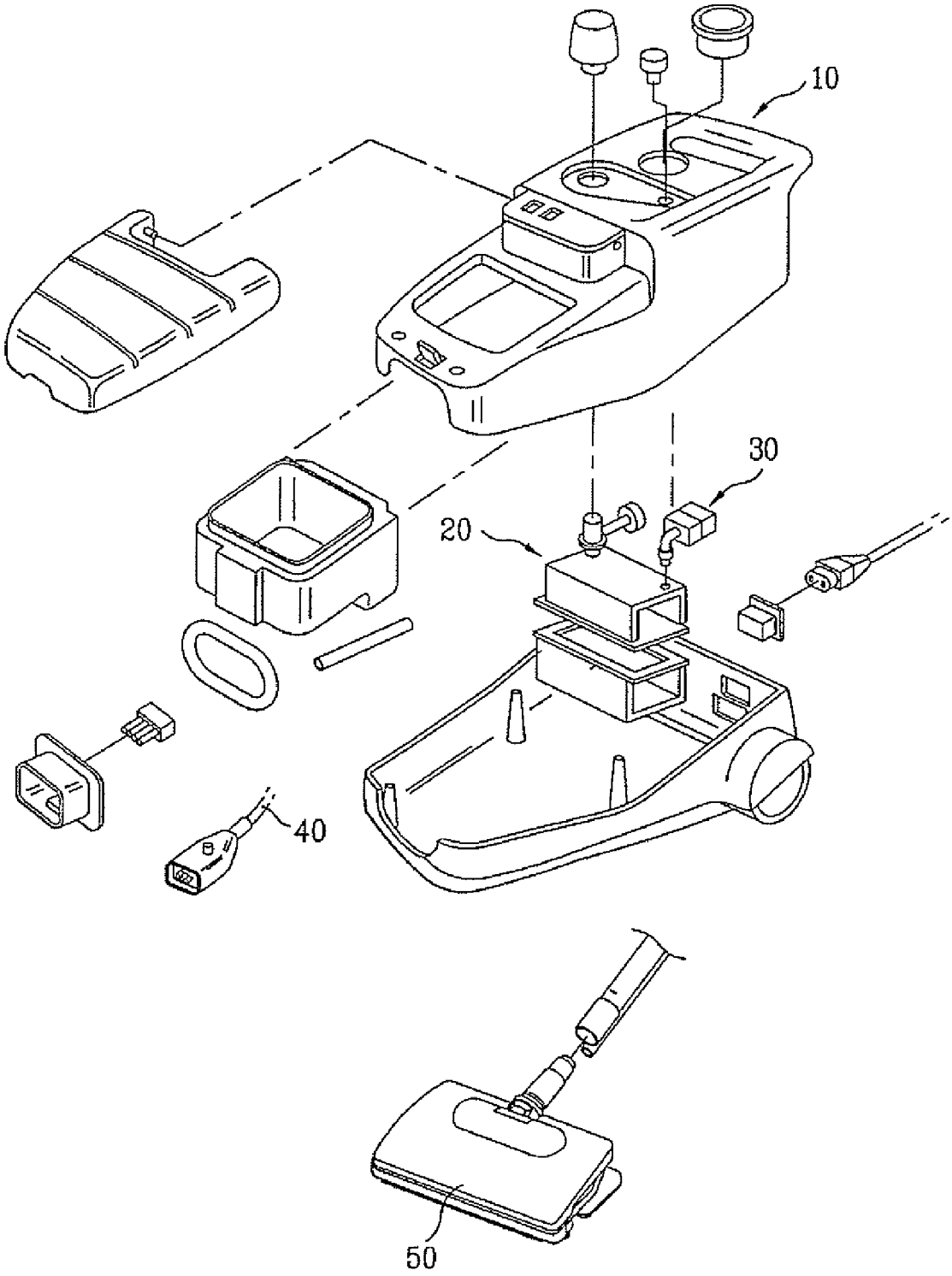
FIG. 1 is an exploded perspective view of a steam cleaner according to a related art.
Figure 2:
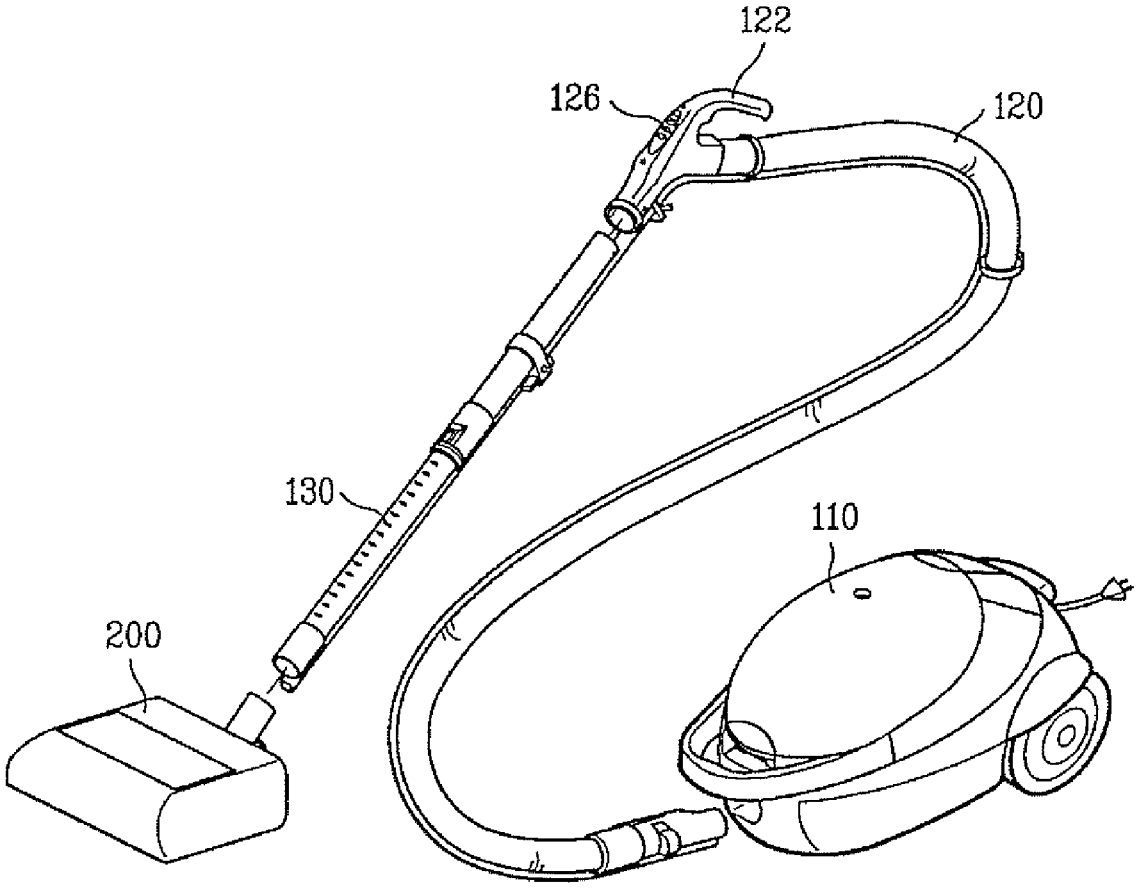
FIG. 2 is a perspective view of a vacuum cleaner according to the present invention.

FIG. 2 is a perspective view of a vacuum cleaner according to one embodiment of the present invention. Referring to FIG. 2, a vacuum cleaner according to one embodiment of the present invention includes a vacuum or cleaner unit 110 which generates a strong air suction force created by a vacuum source. This may be provided in any suitable manner, such as by operation of a motor provided in the vacuum unit 110. An extension pipe 120 is connected to extend from the vacuum unit 110 to guide and carry air and dust to an inside of the vacuum unit 110, and an intake port unit 200 is detachably attached to an end of the extension pipe 120 to suck particles such as dust or dirt while moving along a floor.

A grip portion 122 is provided in the middle of the extension pipe 120. The grip portion 122 is provided with a control portion 126 which may be manipulated by a user for control. For example, the control portion 126 may control activation of the vacuum source in the vacuum unit 110, and activation of a steam generator in the intake port unit 200.

Preferably, a portion of the extension pipe 130 between the grip portion 122 and an end portion where the intake port unit 200 is connected, is extensible or retractable, such as in a step by step manner, to adjust its length.

In using the above-configured vacuum cleaner, a user may turn on a switch of the control part 126 to activate the motor. When activated, a negative pressure is generated beneath the intake port unit 200 to perform a cleaning by sucking dust together with surrounding air.

Figure 3:
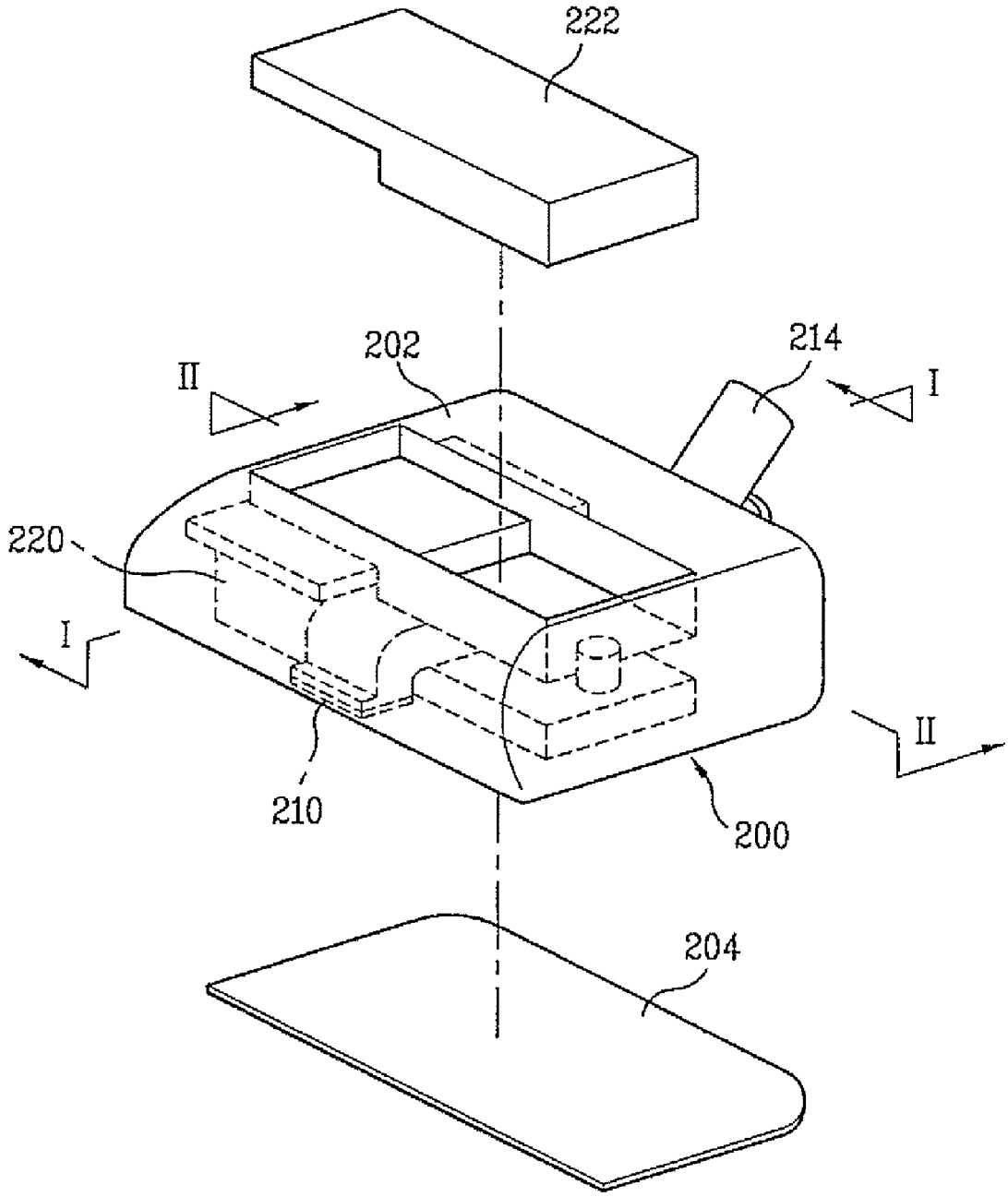
FIG. 3 is an exploded perspective view of an intake port unit of a vacuum cleaner according to one embodiment of the present invention.

FIG. 3 is an exploded perspective view of an intake port unit of a vacuum cleaner according to one embodiment of the present invention.

Figure 5:
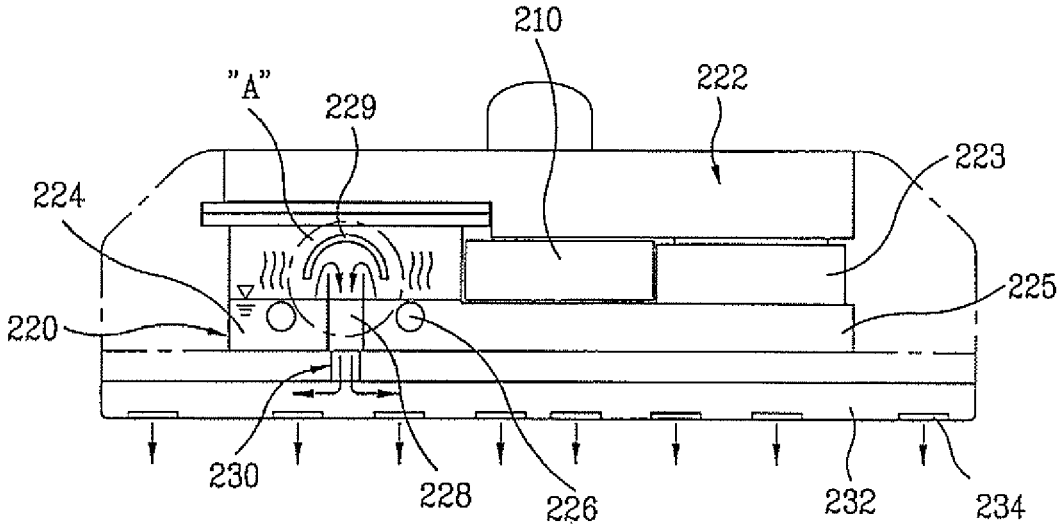
FIG. 5 is a cross-sectional view of the intake port unit shown in FIG. 3 along line II-II, in which a configuration of a steam generator and a flow path of steam are depicted.

Referring to FIG. 3, the intake port unit 200 includes a case or housing 202 configured as an exterior of the intake port unit 200, a vacuum intake passage 210 provided within the housing 202, a steam generator 220 provided within the housing 202, and a steam discharge passage 230 (as shown in FIG. 5) provided within the housing 202.

The vacuum intake passage 210 is a path via which the exterior air sucked from the floor into the vacuum cleaner flows. The steam generator 220 is a device that generating steam by heating water. The steam generator 220 is provided within the housing 202 of the intake port unit 200. The steam discharge passage 230 is partitioned from the vacuum intake passage 210.

Figure 4:
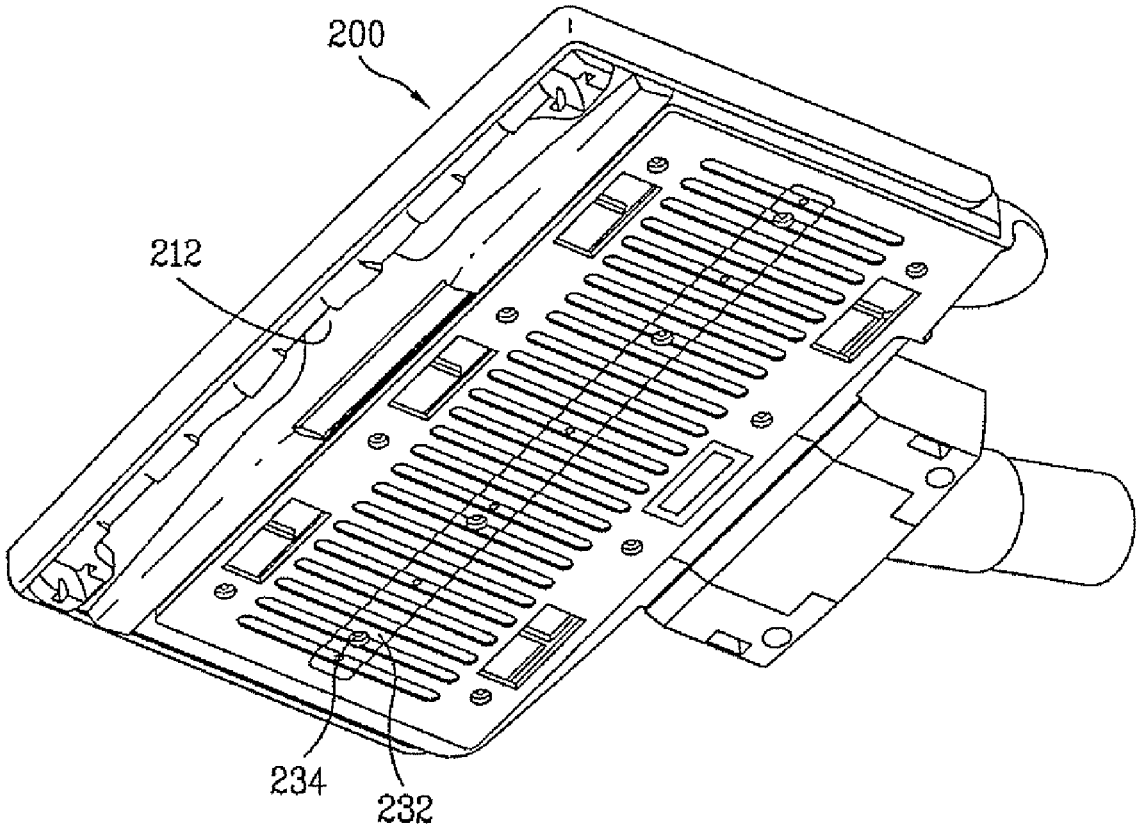
FIG. 4 is a perspective view of a bottom of the intake port unit shown in FIG. 3.

Referring to FIG. 4, a vacuum intake port 212 is provided at one side of a bottom of the intake port unit 200 and communicates with the vacuum intake passage 210. A steam discharge port 232 communicating with the steam generator 220 is provided at an opposite side of the bottom of the intake port unit 200, and is spaced apart from the vacuum intake port 212 by a predetermined distance. It is preferable that the vacuum intake port 212 is provided at a front side of the bottom of the intake port unit 200.

A connecting pipe 214 connected to the end portion of the extension pipe 130 communicates with the vacuum intake passage 210. Preferably, the connecting pipe 214 is provided at a side opposite the side where the vacuum intake port 212 is located. The connecting pipe 214 may be rotatable relative to the intake port unit 200 in all directions to facilitate cleaning operations.

The steam discharge port 232 is provided at a bottom of the housing 202 between the vacuum intake port 212 and the connecting pipe 214. The steam discharge port 232 is configured to have a length in a horizontal direction. A multitude of steam discharge holes 234 are provided to the steam discharge port 232 to spray the steam. As shown in FIG. 4, the steam discharge holes 234 may extend transversely to the steam discharge port 232.

A floorcloth 204 can be detachably attached to the bottom of the housing 202. Preferably, the floorcloth 204 covers the steam discharge port 232 without blocking the vacuum intake port 212.

FIG. 5 is a cross-sectional view of the intake port unit shown in FIG. 3 along line II-II, in which a configuration of a steam generator and a flow path of steam are shown.

The steam generator 220 may include a water tank 222 provided within the housing 202 and a boiler 224 provided within the housing 202 for generating steam by heating water supplied from the water tank 222.

The water tank 222 may be detachably assembled or inserted into the intake port unit 200. The water tank 222 may be detachably connected to the boiler 224 by a valve 223 which is configured as a connecting portion between the water tank 222 and the boiler 224.

The valve 223 is provided at one side of the boiler 224. The valve 223 is configured to be connected to the water tank 222 in an open condition and supplied with water if the water tank 222 is inserted into the housing 202. The valve 223 is configured to be separated from the water tank 222 and in a closed condition if the water tank 222 is removed from the housing 202. The valve 223 may also be configured to control supply of water to enable the boiler 224 to maintain a prescribed water level.

In the present embodiment, it is exemplarily described that the water tank 222 is detachably provided to the intake port unit 200. Alternatively, the water tank may be fixed to the intake port unit 200, and provided with a water supply port that is externally exposed.

The boiler 224 includes a boiler housing or case 225 configured as an exterior of the boiler 224, a heater 226 for heating water, and a steam discharge pipe 228 for guiding the generated steam to a steam discharge passage 230.

The boiler case 225 defines a space for storing water supplied from the water tank 222. The heater 226 is provided within the boiler case 225 to heat the water within the boiler case 225. The heater 226 is preferably located adjacent to a bottom of the boiler case 225. The heater 226 may be provided in any suitable form, such as a burner.

The steam discharge pipe 228 guides the steam generated from the boiler case 225 to the steam discharge passage 230. The steam discharge pipe 228 is vertically provided within the boiler case 225. An upper end of the steam discharge pipe 228 is spaced apart from an upper wall or ceiling of the boiler case 225 by a predetermined gap or space. A lower end of the steam discharge pipe 228 is configured to communicate with the steam discharge port 232.

Preferably, a cap or shield 229 is provided in the boiler case 225 between the ceiling of the boiler case 225 and the upper end of the steam discharge pipe 228. The shield 229 functions to prevent condensed water from entering the steam discharge pipe 228. The cap 229 is configured to have a conical shape of which the circumference increases downwardly.

An operational control may be provided to the control portion 126 of the grip part 122 to turn on/off the steam generator and to adjust the amount of steam generated.

When the vacuum cleaner according to this embodiment of the invention is activated, the motor within the cleaner unit 110 is driven to generate a suction force. The suction force is transferred to the intake port unit 200 via the intake hose 120 and the extension pipe 130.

Figure 6:
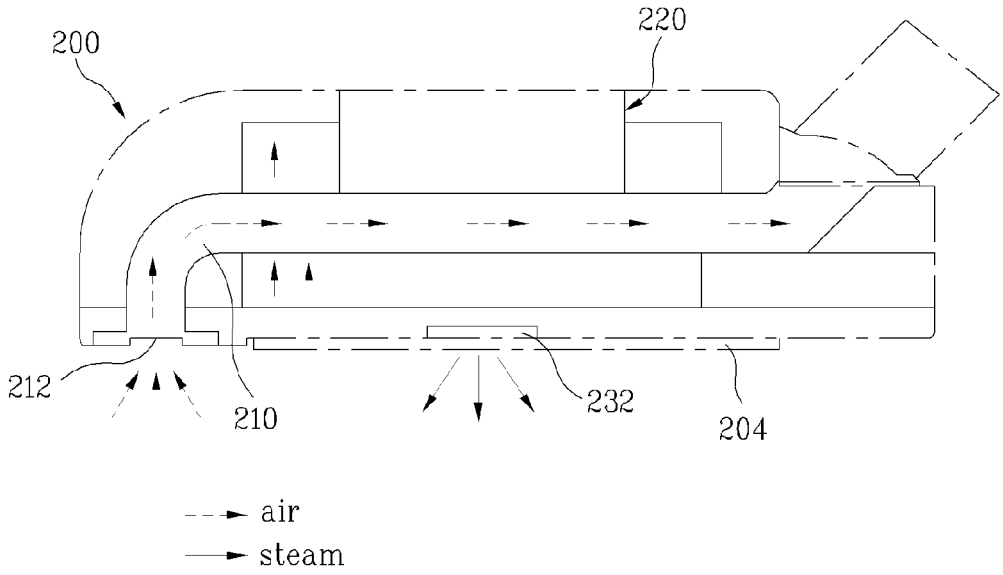
FIG. 6 is a cross-sectional view of the intake port unit shown in FIG. 3 along line I-I, in which a flow path of air and a flow path of steam are depicted.

FIG. 6 is a cross-sectional view of the intake port unit shown in FIG. 3 along line I-I, in which a flow path of air and a flow path of steam are schematically shown.

Referring to FIG. 5 and FIG. 6, air and particles are sucked into the vacuum intake passage 210 via the vacuum intake port 212 of the intake port unit 200.

The steam generator 220 may also be activated. A user fills the water tank 222 with water in advance and then assembles the water tank 222 to the intake port unit 200. The water flows out of the water tank 222 into the boiler case 225 via the valve 223.

Subsequently, the heater 226 is turned on. Once the heater 226 is turned on, the water within the boiler case 225 is heated to generate steam.

The generated steam increases within the boiler case 225 and is then guided to the steam discharge port 232 via the steam discharge pipe 228. The guided steam is discharged via the steam discharge port 232 to wet a floor or the floor cloth 204 attached to the bottom of the intake port unit 200.

In the housing 202, the steam discharge passage 230 is the path of the generated steam within the intake port unit 200 until the generated steam is discharged. In the present embodiment, the steam discharge passage 230 corresponds to the path extending between an end portion of the steam discharge pipe 228 and the steam discharge holes 234.

In particular, since the vacuum intake passage 210 is partitioned from the steam discharge passage 230, the steam is prevented from being sucked directly into the cleaner unit 110 via the vacuum intake passage 210.

Some of the generated steam is condensed on the upper wall or ceiling of the boiler case 225, whereby condensed water **250*a* forms on the ceiling. If the condensed water 250*a* is allowed to fall into the upper end of the steam discharge pipe 228 to be introduced into the steam discharge passage 230**, water may be discharged onto the floor, or wet the floorcloth excessively, which will reduce the cleaning performance of the cleaner.

Figure 7:
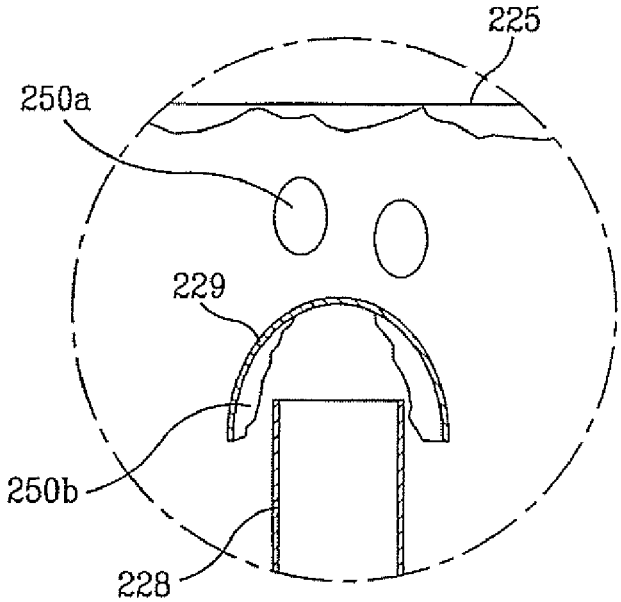
FIG. 7 is an enlarged cross-sectional view of a portion "A" shown in FIG. 5.

FIG. 7 is an enlarged cross-sectional diagram of a portion "A" shown in FIG. 5. Referring to FIG. 7, since the conical cap or shield 229 is provided between the steam discharge pipe 228 and the ceiling of the boiler case 225, the condensed water **250*a* falling from the ceiling of the boiler case 225 falls onto an upper surface of the cap 229, rather than into the steam discharge pipe 228. The condensed water 250*b* is directed to fall back into the boiler case 225 via the inclined walls of the cap 229**. Thus, the condensed water may be re-heated to turn into steam.

In this manner, only steam is introduced into the steam discharge pipe 228, enhancing the cleaning performance. Since the falling condensed water **250*a* and 250*b* is recollected in the boiler case 225**, water is not unnecessarily wasted, which provides for a longer cleaning operation time.

When a user performs cleaning using the vacuum cleaner, the extension pipe 130 and the intake port unit 200 are normally pushed along a floor. After dust on the floor has been sucked into the vacuum intake port 212, smudging filth or stains can be wiped off by application of the steam and the floorcloth 204.

Accordingly, the present invention provides the following effects or advantages.

First, the present invention enables both vacuum cleaning and steam cleaning to wipe off smudged filth and stains, thereby enabling a more powerful cleaning to enhance user's convenience.

Second, since a steam generator is provided in an intake port unit, a flow path of steam is greatly shortened. As a result, a pressure and temperature of the steam can be preserved while the steam flows to the point of discharge. In this manner, a steam cleaning power is preserved. Since compensation for the reduction of the pressure and temperature of the steam over a longer flow path does not need to be taken into consideration, design of a cleaner is facilitated, and product and operation costs can be reduced.

Third, condensed water turning from steam is prevented from being introduced into a steam discharge pipe by a cap provided over the steam discharge pipe. In this manner water is prevented from falling on a floor or wetting a floorcloth excessively. Accordingly, cleaning performance can be enhanced.

Fourth, since condensed water is recollected into a boiler housing instead of falling into a steam discharge pipe to be wasted, unnecessary water waste can be prevented. Accordingly, a longer cleaning time can be secured under the same conditions.

It will be apparent to those skilled in the art that various modifications and variations can be made in the present invention without departing from the spirit or scope of the inventions. Thus, it is intended that the present invention covers such modifications and variations of the invention.

What is claimed is:

1. An intake port unit for a vacuum cleaner, comprising:
- a housing;
- a vacuum intake passage provided within the housing for passage of air sucked in from the exterior of the housing;
- a steam generator provided within the housing to generate steam; and
- a steam discharge passage provided within the housing for passage of steam discharged to the exterior of the housing, wherein the steam discharge passage is partitioned from the vacuum intake passage;
- wherein the steam generator comprises:
- a water tank provided within the housing; and
- a boiler that heats water supplied from the water tank, the boiler comprising:
- a boiler case storing the water supplied from the water tank;
- a heater provided in the boiler case to heat the water in the boiler case to generate steam; and
- a steam discharge pipe having an upper end positioned within the boiler case, spaced from an upper wall of the boiler case, and a lower end communicating with the steam discharge passage.

2. The intake port unit of claim 1, further comprising:
- a vacuum intake port provided on one side of a bottom of the housing to suck in exterior air, the vacuum intake port being connected to the vacuum intake passage; and
- a steam discharge port provided on another side of the bottom of the housing spaced from the vacuum intake port to discharge steam, the steam discharge port being connected to the steam discharge passage.

3. The intake port unit of claim 2, wherein a floorcloth is detachably attached to the bottom of the housing over the steam discharge port.

4. The intake port unit of claim 1, wherein the vacuum intake passage is configured to be connected to a vacuum source outside of the housing.

5. The intake port unit of claim 1, wherein a floorcloth is detachably attached to a bottom of the housing.

6. The intake port unit of claim 1, wherein the water tank is configured to be removed from and inserted into the housing.

7. The intake port unit of claim 6, the steam generator further comprising a valve for connecting the water tank and the boiler, wherein the valve is configured to be opened when the water tank is inserted into the housing, and closed when the water tank is removed from the housing.

8. The intake port unit of claim 1, the boiler further comprising a shield positioned between the upper end of the steam discharge pipe and the upper wall of the boiler case to prevent condensed water from entering the steam discharge pipe.

9. The intake port unit of claim 8, wherein the shield has a conical shape with a downwardly increasing circumference to prevent condensed water on the upper wall of the boiler case, and condensed water on a bottom of the shield, from entering the steam discharge pipe.

10. A vacuum cleaner comprising:
- a vacuum unit containing a suction source;
- a pipe extending from the vacuum unit to provide a passage for air intake; and
- an intake port unit connected to an end portion of the pipe to suck in exterior air from a surface to be cleaned, the intake port unit containing a steam generator that generates steam, and a steam discharge passage through which steam is discharged toward the surface to be cleaned,
- wherein the intake port unit comprising:
- a housing containing the steam generator and the steam discharge passage; and
- a vacuum intake passage provided within the housing for passage of air sucked in from the exterior of the housing,
- wherein the steam discharge passage is partitioned from the vacuum intake passage,
- the steam generator comprises:
- a water tank provided within the housing and
- a boiler that heats water supplied from the water tank, the boiler comprising:
- a boiler case storing the water supplied from the water tank;
- a heater provided in the boiler case to heat the water in the boiler case to generate steam; and
- a steam discharge pipe having an upper end positioned within the boiler case, spaced from an upper wall of the boiler case, and a lower end communicating with the steam discharge passage.

11. The vacuum cleaner of claim 10, further comprising a control unit provided on the pipe for selectively activating the suction source and the steam generator.

12. The vacuum cleaner of claim 10, wherein the intake port unit further comprises:
- a vacuum intake port provided on one side of a bottom of the housing to suck in exterior air, the vacuum intake port being connected to the vacuum intake passage; and
- a steam discharge port provided on another side of the bottom of the housing spaced from the vacuum intake port to discharge steam, the steam discharge port being connected to the steam discharge passage.

13. The vacuum cleaner of claim 10, wherein a floorcloth is detachably attached to a bottom of the housing.

14. The vacuum cleaner of claim 10, wherein the water tank is configured to be removed from and inserted into the housing.

15. The vacuum cleaner of claim 14, the steam generator further comprising a valve for connecting the water tank and the boiler, wherein the valve is configured to be opened when the water tank is inserted into the housing, and closed when the water tank is removed from the housing.

16. The vacuum cleaner of claim 10, the boiler further comprising a shield positioned between the upper end of the steam discharge pipe and the upper wall of the boiler case to prevent condensed water from entering the steam discharge pipe.

* * * * *